US005689149A

United States Patent [19]

Welles, Jr. et al.

[11] Patent Number: 5,689,149

[45] Date of Patent: Nov. 18, 1997

[54] COLOR PICTURE TUBE HAVING SHADOW MASK WITH IMPROVED APERTURE SHAPES

[75] Inventors: Thomas Dickson Welles, Jr., York; Craig Clay Eshleman, Pequea, both of Pa.

[73] Assignee: Thomson Consumer Electronics, Inc., Indianapolis, Ind.

[21] Appl. No.: 557,471

[22] Filed: Nov. 14, 1995

[51] Int. Cl.[6] ..... H01J 29/80

[52] U.S. Cl. ..... 313/402; 313/403

[58] Field of Search ..... 313/402, 403, 313/404, 407, 408

[56] References Cited

U.S. PATENT DOCUMENTS

| | | | |
|---|---|---|---|
| Re. 26,251 | 8/1967 | Kaplan | 313/92 |
| 3,633,058 | 1/1972 | Kouno . | |
| 4,139,797 | 2/1979 | Rowe | 313/408 |
| 4,159,177 | 6/1979 | Elshof et al. | 313/403 |
| 4,636,683 | 1/1987 | Tokita et al. | 313/403 |
| 4,701,665 | 10/1987 | Suzuki | 313/402 |
| 5,055,736 | 10/1991 | Yun et al. | 313/402 |
| 5,616,985 | 4/1997 | Hosotani | 313/403 |

*Primary Examiner*—Sandra L. O'Shea
*Assistant Examiner*—Vip Patel
*Attorney, Agent, or Firm*—Joseph S. Tripoli; Dennis H. Irlbeck

[57] ABSTRACT

An improved color picture tube includes a shadow mask and a dot screen, wherein the mask has two long sides and two short sides. The long sides of the mask parallel a central major axis of the mask, and the short sides parallel a central minor axis of the mask. The mask includes an array of apertures. The improvement comprises each of the shadow mask apertures being substantially rectangular with four sides. Two of the aperture sides approximately parallel the major axis and establish aperture height. The other two aperture sides approximately parallel the minor axis and establish aperture width The widths and heights of the apertures increase at a first rate and a second rate, respectively, from the center to the sides of the mask, along the major axis; and the widths and heights of the apertures increase at a third rate and a fourth rate, respectively, from the center to the top and bottom of the mask, along the minor axis.

7 Claims, 3 Drawing Sheets

COLOR PICTURE TUBE HAVING SHADOW MASK WITH IMPROVED APERTURE SHAPES

This invention relates, generally, to color picture tubes having shadow masks for use with dot screens, wherein the shadow mask apertures are usually aligned in staggered rows and columns; and, particularly, to improved shadow mask aperture shapes for obtaining uniform light output from the dot screens.

BACKGROUND OF THE INVENTION

Most color picture tubes used for television viewing have greater light output at the centers of their screens than in the peripheral areas of the screens. This difference in light output occurs because the electron beams in a tube grow in size and spread apart with increases in electron beam deflection. Furthermore, it is also common to increase the spacing between shadow mask apertures at the periphery of the mask. When viewing a television scene, the difference in light output is rarely noticed, because the center of the scene is usually centered on a tube's screen. However, in many other color picture tube uses, such as in color display monitors, it is desirable to maintain uniform light output over the entire screen. The present invention provides a color picture tube with a shadow mask having novel-shaped apertures that can be used to achieve such uniform light output.

SUMMARY OF THE INVENTION

In accordance with the present invention, an improved color picture tube includes a shadow mask and a dot screen, wherein the mask has two long sides and two short sides. The long sides of the mask parallel a central major axis of the mask, and the short sides parallel a central minor axis of the mask. The mask includes an array of apertures. The improvement comprises each of the shadow mask apertures being substantially rectangular with four sides. Two of the aperture sides approximately parallel the major axis and establish aperture height. The other two aperture sides approximately parallel the minor axis and establish aperture width. The widths and heights of the apertures increase at a first rate and a second rate, respectively, from the center to the sides of the mask, along the major axis, and the widths and heights of the apertures increase at a third rate and a fourth rate, respectively, from the center to the top and bottom of the mask, along the minor axis.

DETAILED DESCRIPTION OF THE PREFERRED EMBODIMENTS

Figure 1:
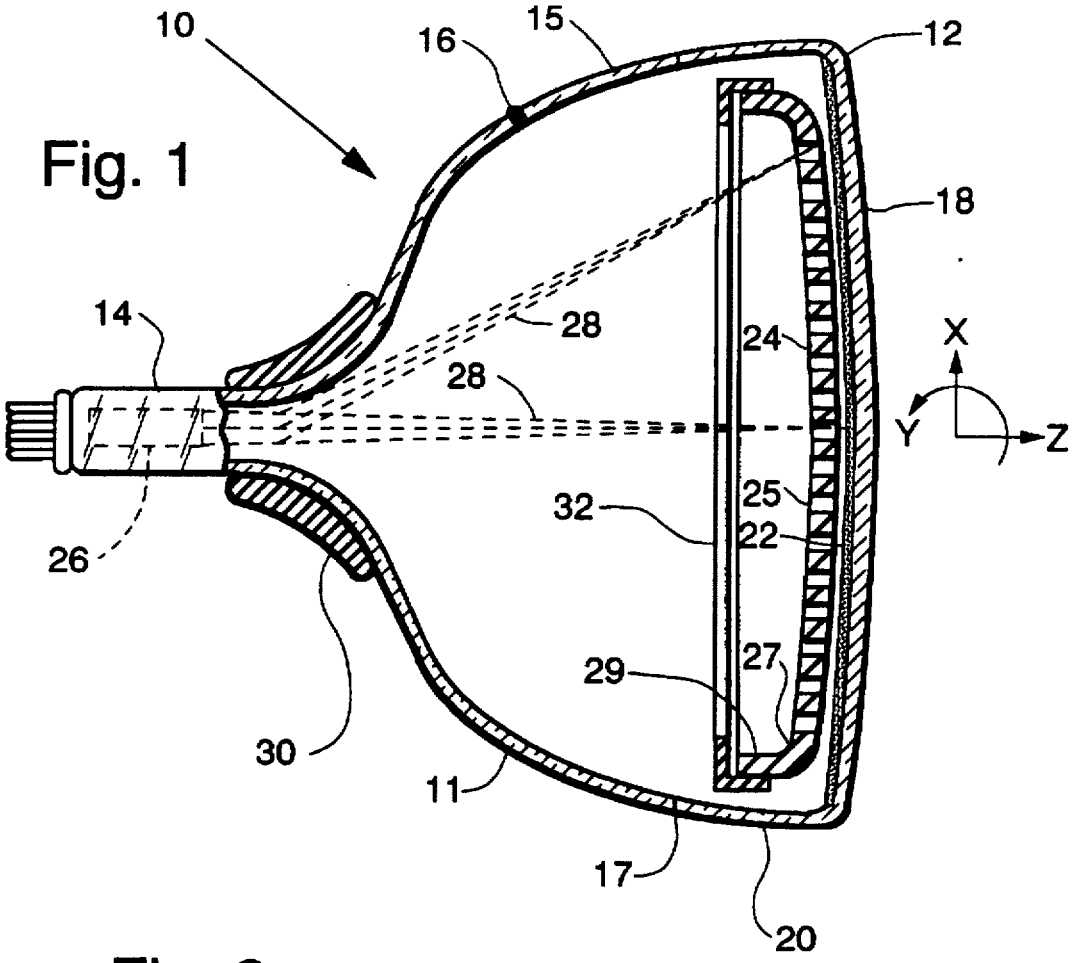
FIG. 1 is a partially sectioned axial side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a dot screen, with the phosphor dots arranged in triads, each triad including a phosphor dot of each of three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14, to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1. The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within (or, alternatively, over) the frame 34, and the skirt portion 29 is welded to the frame 34.

Figure 2:
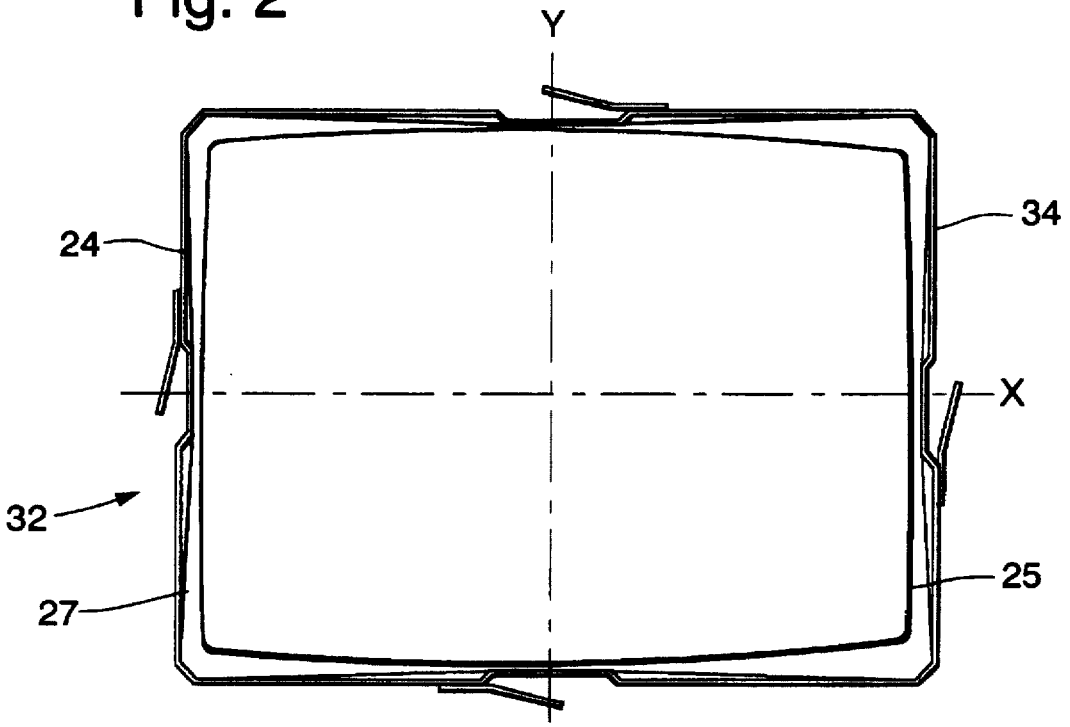
FIG. 2 is a front plan view of a shadow mask-frame assembly of the tube of FIG. 1.
Figure 3:
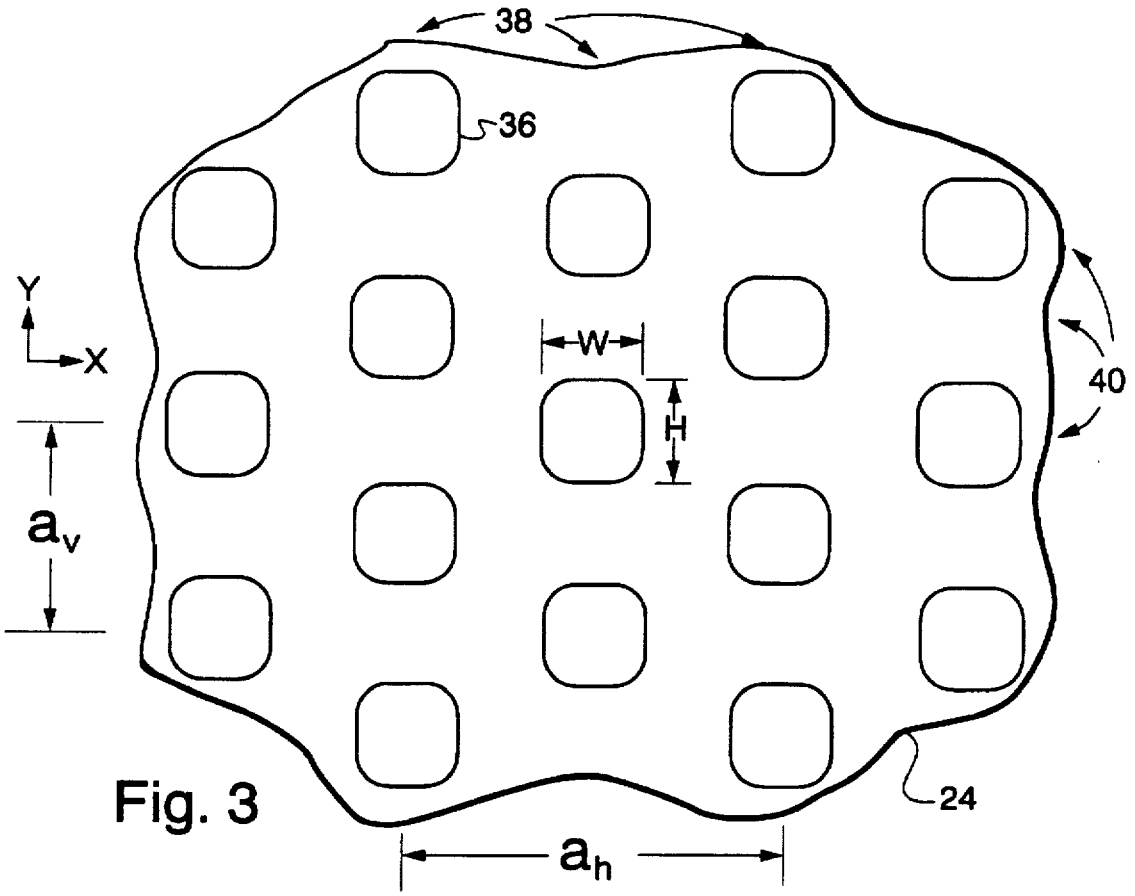
FIG. 3 is a small section of the shadow mask of the assembly of FIG. 2.

The shadow mask 24, shown in plan view in FIG. 2, has a rectangular periphery with two long sides and two short sides. The mask 24 has a major axis X, which passes through the center of the mask and parallels the long sides, and a minor axis Y, which passes through the center of the mask and parallels the short sides. The mask 24 includes an array of apertures 36, arranged in staggered vertical columns 38 and horizontal rows 40, as shown in detail in FIG. 3. The columns 38 approximately parallel the minor axis Y, and the rows 40 approximately parallel the major axis X. The apertures in one row are in different columns than the apertures in the adjacent rows. The vertical spacing between adjacent apertures in the same column is defined as the vertical pitch $a_v$ of the apertures, and the horizontal spacing between adjacent apertures in the same row is defined as the horizontal pitch $a_h$ of the apertures. These pitches can be adjusted to obtain a desired spacing of phosphor dot trios. Proper spacing of phosphor dot trios requires a greater shadow mask contour, which results in increased electron beam tolerance, improved dent protection during handling and improved thermal stability.

Each shadow mask aperture has four sides, with rounded corners, in a somewhat rectangular shape. Two of the aperture sides approximately parallel the major axis to establish the height H dimension of an aperture, and two of the aperture sides approximately parallel the minor axis to establish the width W dimension of an aperture. In a preferred embodiment, because the spot size of an electron beam usually grows toward the edge of the screen, the sizes of the apertures are varied to somewhat match the spot growth. To effect this matching, the widths and heights of the apertures increase at a first rate and a second rate, respectively, from the center to the sides of the mask, along the major axis, and the widths and heights of the apertures increase at a third rate and a fourth rate, respectively, from center to the top and bottom of the mask, along the minor axis. The third rate is usually lower than is the first rate.

Figure 4:
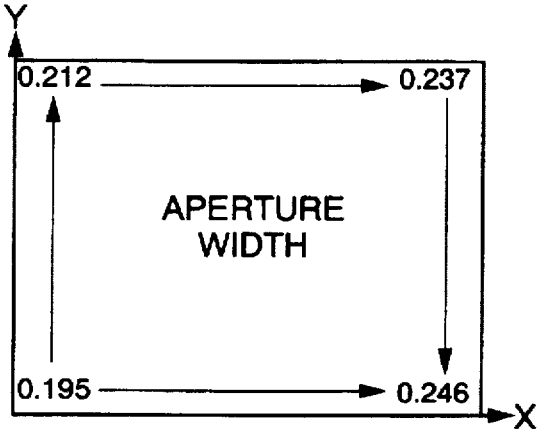
FIG. 4 is an upper right quadrant of one embodiment of the shadow mask of FIG. 2, showing the aperture width, W, at four locations.
Figure 5:
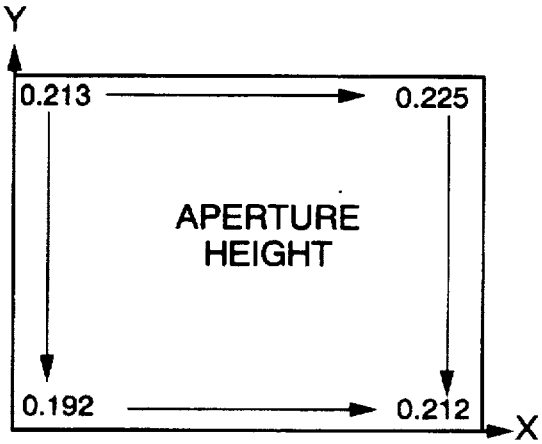
FIG. 5 is an upper right quadrant of the one embodiment of the shadow mask of FIG. 2, showing the aperture height, H, at four locations.

The aperture widths W and heights H at four different locations on an upper right quadrant of an aperture array of a mask, in an exemplary 51 cm diagonal tube, are given in FIGS. 4 and 5, respectively. The four locations are at the center of the mask; at the top of the aperture array, along the minor axis; at the right side of the aperture array, along the major axis; and at the upper right corner of the aperture array. Aperture widths and heights in the other three quadrants of the aperture array are the same as those given in the upper right quadrant, reflected about the major axis X and minor axis Y. In this particular mask, the aperture width W increases at a first rate from 0.195 mm at the center of the mask to 0.246 mm at the sides of the aperture array, along the major axis, and at a third rate to 0.212 mm at the top and bottom of the aperture array, along the minor axis. The aperture width at the corners of the aperture array is 0.237 mm, which is greater than the widths at the top and bottom of the aperture array, along the minor axis, but less than at the sides of the aperture array, along the major axis. The aperture height H increases at a second rate from 0.192 mm at the center of the mask to 0.212 mm at the sides of the aperture array, along the major axis, and at a fourth rate to 0.213 mm at the top and bottom of the aperture array, along the minor axis. The aperture height at the corners of the aperture array is 0.225 mm, which is greater than the heights at the top and bottom of the aperture array, along the minor axis and at the sides of the aperture array, along the major axis.

Figure 6:
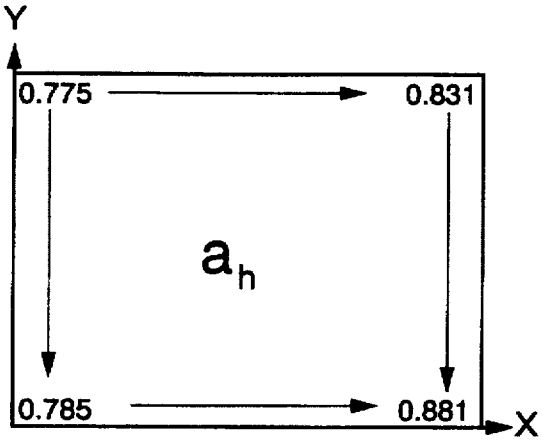
FIG. 6 is an upper right quadrant of the one embodiment of the shadow mask of FIG. 2, showing the horizontal pitches between apertures within rows at four locations.
Figure 7:
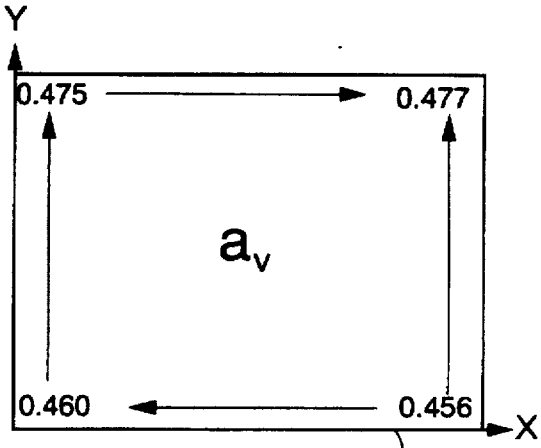
FIG. 7 is an upper right quadrant of the one embodiment of the shadow mask of FIG. 2, showing the vertical pitches between apertures within columns at four locations.

The horizontal pitch $a_h$ and the vertical pitch $a_v$ of the mask apertures at four different locations on the upper right quadrant of the mask, in the exemplary 51 cm diagonal tube, are shown in FIGS. 6 and 7, respectively. Along the minor axis Y, the horizontal pitch $a_h$ decreases from 0.785 mm at the center of the mask to 0.775 mm at the top and bottom of the aperture array. Along the major axis, the horizontal pitch $a_h$ increases to 0.881 mm at the sides of the array. The horizontal pitch $a_h$, at the corners of the aperture array, is 0.831 mm, which is greater than the horizontal pitches at the top and bottom of the aperture array, along the minor axis, but less than the horizontal pitch at the sides of the aperture array, along the major axis. The vertical pitch $a_v$ increases from 0.460 mm at the center of the mask to 0.475 mm at the top and bottom of the aperture array, along the minor axis, but decreases to 0.456 mm at the sides of the aperture array, along the major axis. The vertical pitch $a_v$ at the corners of the aperture array is 0.477 mm, which is greater than the horizontal pitches at the top and bottom of the aperture array, along the minor axis, and at the sides of the aperture array, along the major axis.

The technique disclosed herein for independently varying both the aperture width and aperture height allows for the maximizing of electron beam tolerance and uniform light output, consistent with the variations in electron beam trio spacing, on a dot screen.

What is claimed is:

1. In a color picture tube having a shadow mask, a dot screen and an electron gun for producing and directing a plurality of electron beams through said mask to said screen, said mask having two long sides and two short sides, said long sides paralleling a central major axis of said mask, and said short sides paralleling a central minor axis of said mask, and said mask including an array of apertures, the improvement comprising each of said shadow mask apertures being substantially rectangular with four sides, two of said aperture sides approximately paralleling said major axis and establishing aperture height and two of said aperture sides approximately paralleling said minor axis and establishing aperture width, the widths and heights of said apertures increasing at a first rate and a second rate, respectively, from the center to the sides of said mask, along said major axis, and the widths and heights of said apertures increasing at a third rate and a fourth rate, respectively, from the center to the top and bottom of said mask, along said minor axis.

2. The tube as defined in claim 1, wherein said third rate is lower than said first rate.

3. The tube as defined in claim 1, wherein the center-to-center spacing between shadow mask apertures, in the direction of the major axis, increases from center to edge along the major axis, and decreases from center to edge along the minor axis.

4. In a color picture tube having a shadow mask, a dot screen and an electron gun for producing and directing three electron beams through said mask to said screen, said mask being rectangular and having two long sides and two short sides, said long sides paralleling a central major axis of said mask, and said short sides paralleling a central minor axis of said mask, said mask including an array of apertures arranged in columns and rows, the apertures in one row being in different columns than are the apertures in adjacent rows, and the size of the electron beam spots at said screen increasing with increasing distance from the center of said screen, the improvement comprising each of said shadow mask apertures having four sides with rounded corners in a substantially rectangular shape, two of said aperture sides approximately paralleling said major axis and establishing aperture height and two of said aperture sides approximately paralleling said minor axis and establishing aperture width, the widths and heights of said apertures increasing at a first rate and a second rate, respectively, from the center to the sides of said mask, along said major axis in a manner approximately proportional to the increase in the horizontal and vertical dimensions of said electron beam spots at said screen, and the widths and heights of said apertures increasing at a third rate and a fourth rate, respectively, from the center to the top and bottom of said mask, along said minor axis, in a manner approximately proportional to the increase in horizontal and vertical dimensions of said electron beam spots at said screen.

5. The tube as defined in claim 4, wherein said third rate is lower than said first rate.

6. The tube as defined in claim 4, wherein the center-to-center spacing between said shadow mask apertures, in the direction of said major axis, increases from center to edge along the major axis and decreases from center to edge along the minor axis.

7. The tube as defined in claim 1, wherein the center-to-center spacing between said shadow mask apertures, in the direction of said minor axis, decreases from center to edge along the major axis and increases from center to edge along the minor axis.

* * * * *